US011282692B2

(12) United States Patent
Jordan

(10) Patent No.: US 11,282,692 B2
(45) Date of Patent: Mar. 22, 2022

(54) IMR-MS DEVICE

(71) Applicant: IONICON ANALYTIK GESELLSCHAFT M.B.H., Innsbruck (AT)

(72) Inventor: Alfons Jordan, Innsbruck (AT)

(73) Assignee: IONICON ANALYTIK GESELLSCHAFT M.B.H., Innsbruck (AT)

( * ) Notice: Subject to any disclaimer, the term of this patent is extended or adjusted under 35 U.S.C. 154(b) by 0 days.

(21) Appl. No.: 17/046,111

(22) PCT Filed: Sep. 27, 2019

(86) PCT No.: PCT/EP2019/076192

§ 371 (c)(1),
(2) Date: Oct. 8, 2020

(87) PCT Pub. No.: WO2020/065013

PCT Pub. Date: Apr. 2, 2020

(65) Prior Publication Data

US 2021/0134578 A1 May 6, 2021

(30) Foreign Application Priority Data

Sep. 28, 2018 (EP) ..... 18197502

(51) Int. Cl.
*H01J 49/14* (2006.01)
*H01J 49/04* (2006.01)
(Continued)

(52) U.S. Cl.
CPC ..... *H01J 49/145* (2013.01); *H01J 49/0422* (2013.01); *H01J 49/061* (2013.01); *H01J 49/107* (2013.01)

(58) Field of Classification Search
CPC .... H01J 49/0422; H01J 49/061; H01J 49/107; H01J 49/14; H01J 49/145
See application file for complete search history.

(56) References Cited

U.S. PATENT DOCUMENTS 6,469,297 B1 * 10/2002 Kato ..... H01J 49/04 250/285
7,095,019 B1 8/2006 Sheehan et al.
(Continued)

FOREIGN PATENT DOCUMENTS

EP 2498273 12/2012
WO WO 2018/050962 3/2018

OTHER PUBLICATIONS

Brophy and Farmer, "A Switchable Reagent Ion High Resolution Time-of-Flight Chemical Ionization Mass Spectrometer for Real-Time Measurement of Gas Phase Oxidized Species: Characterization From the 2013 Southern Oxidant and Aerosol Study", Atmos. Meas. Tech. 8, 2945-2959, 2015 (Year: 2021).*
(Continued)

*Primary Examiner* — David E Smith
(74) *Attorney, Agent, or Firm* — Workman Nydegger

(57) ABSTRACT

The present invention relates to an apparatus and a method for IMR-MS and/or PTR-MS, comprising a sample gas inlet (202, 206), a first ion source (209), a reaction chamber (203), a mass analyzer (204), wherein the reaction chamber (203) and the mass analyzer (204) are arranged along a central axis (A), characterized by a second ion source (209), wherein the sample gas inlet (202, 206) is arranged to introduce gas essentially along the central axis (A) and is connected to the reaction chamber (203); wherein the first ion source (209) and the second ion source (209) are arranged so as to emit reagent ions essentially perpendicularly to the central axis (A); said apparatus further comprising at least one electrode (302, 303, 304, 305), such that the reagent ions emitted from the first or second ion source (209) can be deflected into the reaction chamber (203) essentially in the downstream direction of the central axis (A).

13 Claims, 3 Drawing Sheets

(51) Int. Cl.
*H01J 49/06* (2006.01)
*H01J 49/10* (2006.01)

(56) References Cited

U.S. PATENT DOCUMENTS

| | | | | |
|---|---|---|---|---|
| 9,228,926 | B2 * | 1/2016 | Benter | H01J 49/168 |
| 2003/0116705 | A1 * | 6/2003 | Kanik | G01N 27/622 250/287 |
| 2006/0022132 | A1 * | 2/2006 | Zhang | H01J 49/145 250/290 |
| 2009/0294649 | A1 * | 12/2009 | Shabanowitz | H01J 49/0095 250/282 |
| 2014/0284204 | A1 | 9/2014 | Sipila et al. | |
| 2017/0162372 | A1 * | 6/2017 | Stephenson, Jr. | H01J 49/0445 |
| 2017/0365452 | A1 * | 12/2017 | Green | H01J 49/0009 |

OTHER PUBLICATIONS

Smith et al., "Concurrent Use of H3O+, NO+ and O2+, Precursor Ions for the Detection and Quantification of Diverse Trace Gases in the Presence of Air and Breath by Selected Ion-Flow Tube Mass Spectrometry", Int. Journal of Mass Spectrometry, vol. 209, Issue 1, 2001, p. 81-97 (Year: 2001).*

P. Brophy et al: "A switchable reagent ion high resolution time-of-flight chemical ionization mass spectrometer for real-time measurement of gas phase oxidized species: characterization from the 2013 southern oxidant and aerosol study", Atmospheric Measurement Techniques, vol. 8, No. 7, Jul. 22, 2015, p. 2945-2959.

Bin Yuan et al: "Proton-Transfer-Reaction Mass Spectrometry: Applications in Atmospheric Sciences", Chemical Reviews, vol. 117, No. 21, Oct. 4, 2017, p. 13187-13229.

A.M. Ellis, C.A. Mayhew, "Proton Transfer Reaction in Mass Spectrometry Principles and Applications", John Wiley & Sons LTd., UK, 2014 (Abstract).

A. Hansel et al: "Proton transfer reaction mass spectrometry: on-line trace gas analysis at the ppb level.", International Journal of Mass Spectrometry and Ion Processes, vol. 149/150, p. 609-619, 1995 (Abstract).

Breitenlechner et al:, "An Instrument for Studying the Lifecycle of Reactive Organic Carbon in the Atmosphere", Analytical Chemistry 89, p. 5824-5831, 2017.

Krechmer et al:, "Evaluation of a new vocus reagent-ion source and focusing ion-molecule reactor for use in proton-transfer-reaction mass spectrometry", ChemRxiv, 2018.

International Search Report cited in PCT/EP2019/076192 dated Dec. 16, 2019.

* cited by examiner

IMR-MS DEVICE

The present invention relates to an apparatus for Ion-Molecule-Reaction Mass Spectrometry and/or Proton-Transfer-Reaction Mass Spectrometry, comprising a sample gas inlet, an first ion source, a reaction chamber, a mass analyzer, wherein the reaction chamber and the mass analyzer are arranged along a central axis. The invention further relates to a method to operate an apparatus for Ion-Molecule-Reaction Mass Spectrometry and/or Proton-Transfer-Reaction Mass Spectrometry according to the invention.

BACKGROUND OF THE INVENTION

Ion-Molecule-Reaction Mass Spectrometry (IMR-MS) or Proton-Transfer-Reaction Mass Spectrometry (PTR-MS; both terms are used synonymously throughout this application) is a well-established method for chemical ionization, detection and quantification of (trace) compounds. Details about the technology can e.g. be found in A. M. Ellis, C. A. Mayhew (Proton Transfer Reaction Mass Spectrometry Principles and Applications, John Wiley & Sons Ltd., UK, 2014). Advantages of this technique are high sensitivity, high selectivity, on-line quantification, direct sample injection and short response times. Although most common PTR-MS instruments employ proton transfer from $H_3O^+$ to the analytes, the technology is by no means limited to this form of ionization. Several instruments have been introduced, which enable the use of $NO^+$, $O_2^+$, $Kr^+$ and any other type of positively or negatively charged reagent ions for chemical ionization. In addition to a series of common devices for controlling the various voltages, currents, temperatures, the vacuum, etc., a typical PTR-MS instrument comprises the following main components:

Reagent Ion Source:

In the reagent ion source the reagent ions are formed. Many PTR-MS instruments employ a hollow cathode ion source fed by suitable source gases (e.g. $H_2O$ vapor, $O_2$, $N_2$, noble gases, etc.), but various other designs have been introduced (e.g. point discharge, plane electrode discharge, microwave discharge, radioactive, etc.). Favorable ion sources produce reagent ions of high purity, either because of their sophisticated design or because of the use of mass filters.

Reaction Chamber/Drift Tube:

In the PTR reaction chamber chemical ionization of the analytes takes place via interactions with the reagent ions. The reaction chamber is often also referred to as drift tube or reaction region. While a certain flow of gas containing the analytes is continuously injected, an electric field draws ions along the drift tube. Commonly, air containing traces of impurities (e.g. traces of volatile organic compounds) is analyzed by PTR-MS, but many other matrices containing compounds of interest (e.g. remaining impurities in purified gases, gas standards, etc.) have been successfully investigated with various reagent ions. In some embodiments the matrix containing the analytes (e.g. air with traces of volatile organic compounds) is diluted with a buffer gas prior to injection into the drift tube (e.g. for simple dilution purposes, for the use of particular reagent ions, etc.).

Some of the common reactions between the reagent ion and the analyte taking place in the reaction chamber are:

Proton transfer reactions, either non-dissociative or dissociative, with $A.H^+$ being the reagent ion (in most cases $H_2O.H^+$) and BC being the analyte:

$$A.H^+ + BC \rightarrow A + BC.H^+$$

$$A.H^+ + BC \rightarrow A + B + C.H^+$$

Charge transfer reactions, either non-dissociative or dissociative, with $A^+$ being the reagent ion (e.g. $O_2^+$, $NO^+$, $Kr^+$, etc.) and BC being the analyte:

$$A^+ + BC \rightarrow A + BC^+$$

$$A^+ + BC \rightarrow A + B + C^+$$

Clustering reactions, with $A^+$ being the reagent ion (e.g. $H_3O^+$, $NO^+$, etc.) and BC being the analyte:

$$A^+ + BC \rightarrow BC.A^+$$

In addition other types of reactions can occur (e.g. ligand switching, $H^+$ extraction in case of negatively charged reagent ions, etc.).

Most common drift tubes consist of a series of ring electrodes electrically connected via resistors with equal resistance, so that a DC voltage U can be applied across a drift tube of the length d, resulting in the electric field strength E=U/d (in V/cm).

Mass Analyzer and Detector:

Between the reaction chamber and the mass analyzer there is a transition region to account for the pressure difference between these two regions, as mass analyzers typically operate in high or ultra high vacuum regimes. Various types of mass analyzers have been employed in PTR-MS instruments. The most prominent example for a low resolution mass analyzer is the quadrupole mass filter, whereas for high mass resolution measurements Time-Of-Flight (TOF) analyzers are commonly used in PTR-MS. However, the use of other types of mass analyzers, such as e.g. ion trap analyzers, has also been reported and even MSn (multiple-stage mass spectrometry) could be realized. The mass analyzer separates the ions injected from the drift tube according to their m/z and quantifies the ion yields of the separated m/z with a suitable detector (e.g. secondary electron multiplier, microchannel plate, etc.).

STATE OF THE ART

One of the first PTR-MS instruments, which was introduced already in 1995 (A. Hansel, A. Jordan, R. Holzinger, P. Prazeller, W. Vogel, W. Lindinger, Proton transfer reaction mass spectrometry: on-line trace gas analysis at the ppb level. International Journal of Mass Spectrometry and Ion Processes 149/150 (1995) 609-619) employed a hollow cathode reagent ion source in-line (on the same central axis) with the adjacent drift tube. Perpendicular to this axis the sample inlet was mounted at the beginning of the drift tube. As this early concept is still state-of-the-art in the vast majority of the many hundreds of PTR-MS instruments in use nowadays, it is discussed in some more detail in section "Detailed description of the invention".

Two rare exceptions to the common design have been published by Breitenlechner (An Instrument for Studying the Lifecycle of Reactive Organic Carbon in the Atmosphere. Analytical Chemistry 89 (2017) 5824-5831) and Krechmer (*Evaluation of a new vocus reagent-ion source and focusing ion-molecule reactor for use in proton-transfer-reaction mass spectrometry.* ChemRxiv (2018) preprint). Breitenlechner et al. developed a novel type of PTR-MS instrument specifically designed for atmospheric chemistry with extremely high sample gas flow rates. Their aim was to have the sample inlet as much in the direction of the reaction chamber central axis as possible. However, this inevitably led to a conflict with the position of their corona discharge reagent ion source, which should also be in line with the reaction chamber central axis. The solution they came up with is an embodiment where both, the ion source and the sample inlet, point in the direction of the reaction chamber central axis at a slight off-axis angle. Krechmer et al. came up with a different design where the inlet line points exactly in direction of the reaction chamber central axis and the ion source consists of two conical surfaces (with a plasma burning in between) surrounding the inlet line, thus pointing in direction of the reaction chamber central axis in a slight off-axis angle.

Another example dealing with the conflict between having the ion source and the sample inlet pointing essentially in the direction of the central axis of the reaction chamber is given in U.S. Pat. No. 7,095,019 B1. There, a different type of instrument, which is not a PTR-MS instrument, is described and the conflict is solved by placing the ion sources at an angle of about 45° to the central axis. This choice leads to very limited space in the sample inlet region.

Furthermore, WO 2018/050962 A1 discloses a general Multimethod Ionization Device to utilize chemical ionization and a system utilizing such a device provided with a reaction chamber for ion formation of reagent species, which is again not a PTR-MS instrument. The aim of the ionization instrument in WO 2018/050962 A1 is to detect substances with very high sensitivity, which is achieved by locating several ionization sources in and around the reaction region. The instrument in WO 2018/050962 A1 can answer the question if a certain substance is present in the sample, but cannot quantify the compound and is thus not a PTR-MS instrument.

Two major problems occur with PTR-MS reagent ion source designs so far:

a) Although switching reagent ions, e.g. from $H_3O^+$ to $O_2^+$, has been reported to be relatively rapid, it still takes a considerable amount of time. Based on literature reports and the inventors experience, after about 3 to 4 seconds the main switching process has been completed (mass flow controllers have switched the source gas, the gas in the ion source has partly been replaced and the voltages and pressures have been changed). However, in order to get reagent ions of high purity up to tens of seconds are necessary, e.g. for getting rid of remaining humidity in the ion source. Directly compared to technologies like e.g. Selected Ion Flow Tube-Mass Spectrometry (SIFT-MS), where a quadrupole mass filter is employed to select the reagent ions and switching can be performed within split-seconds, this can be considered as a major drawback of PTR-MS. Installing a mass filter similar to SIFT-MS is not an option for PTR-MS as mass filters never can achieve 100% transmission efficiency and therefore one of the major advantages of PTR-MS would be lost: extremely high sensitivity. No satisfying solution has been proposed to this problem so far.

b) According to the prior art for proper performance it is necessary that the ion source as well as the sample inlet are aligned with the reaction chamber's central axis. Since two devices cannot be at the same place at the same time, such an arrangement is difficult. The reason for this alignment is that i) an extremely high reagent ion current is necessary to achieve extraordinary sensitivity of the PTR-MS instrument (ion source should inject reagent ions into the central axis of the reaction region) and ii) contact of the sample gas to inlet line walls should be avoided because of possible condensation and conversion effects (i.e. a straight inlet without corners, T-pieces, valves, mass flow controllers, etc. is beneficial).

SHORT DESCRIPTION OF THE INVENTION

The object of the present invention is thus to provide an IMR/PTR-MS design which solves the problems mentioned in a) and which meets the requirements mentioned in i) and ii), while introducing no drawbacks.

This object is solved by an apparatus for Ion-Molecule-Reaction Mass Spectrometry and/or Proton-Transfer-Reaction Mass Spectrometry, comprising a sample gas inlet, an ion source section, a first ion source, a reaction chamber, a mass analyzer, wherein the reaction chamber and the mass analyzer are arranged along a central axis, characterized by a second ion source, wherein the sample gas inlet is arranged to introduce gas essentially along the central axis into the ion source section and is connected to the reaction chamber;

wherein the first ion source and the second ion source are arranged essentially in a plane in front of the reaction chamber so as to emit reagent ions essentially perpendicularly to the central axis into the ion source section;

said apparatus further comprising at least one electrode, such that the reagent ions emitted from the first or second ion source into the ion source section can be deflected into the reaction chamber essentially in the downstream direction of the central axis.

The notations "central axis" and "axis of the reaction chamber" are used essentially synonymously. The notation "in the downstream direction of the central axis" means "in the direction of the central axis and in downstream direction".

This object is further solved by a method to operate an apparatus for Ion-Molecule-Reaction Mass Spectrometry and/or Proton-Transfer-Reaction Mass Spectrometry according to one described, characterized by the following steps:

introducing the sample gas into the ion source section via the sample gas inlet in the direction of the central axis of the reaction chamber;

continuously generating at least two different reagent ions in the at least two ion sources, wherein in one respective ion source one specific type of reagent ions is produced;

applying a voltage to the at least one electrode at the exit of each ion source, wherein a certain value of voltage leads to injection of the respective reagent ions into the ion source section and another certain value of the voltage leads to rejection back into the respective ion source;

applying a voltage to the at least one electrode positioned upstream in the vicinity of the sample gas inlet, wherein this electrode causes a repulsive force onto the reagent ions and applying a voltage to the at least one electrode positioned downstream in the vicinity of the reaction chamber, wherein this electrode causes an attracting force onto the reagent ions, such that the reagent ions are injected into the reaction chamber essentially in the downstream direction of the central axis of the reaction chamber;

introducing the reagent ions and/or the sample gas into the reaction chamber, wherein subsequent to the reaction chamber the analyte or the sample gas are analyzed with the mass analyzer.

With respect to the apparatus there are several preferred embodiments.

In a preferred embodiment the apparatus is characterized by at least one further ion source arranged so as to emit reagent ions essentially perpendicularly to the central axis.

Regarding the orientation of the at least two ion sources, the axes (e.g. central axis or longitudinal axes) of the at least two, preferably at least three, ion sources are essentially perpendicular to the central axis of the reaction chamber. In a preferred embodiment the ion sources are arranged essentially in a plane which is essentially perpendicular to the central axis of the reaction chamber.

The apparatus may be further characterized in that said electrodes are connected to a switching device so that emitted reagent ions from one ion source are deflected into the central axis while reagent ions from any other ion source are rejected back into the respective ion source.

Preferably the ion sources are positioned in the area of the ion source section, wherein the reaction chamber is downstream and preferably adjacent to the ion source section.

In a preferred embodiment the apparatus comprises three ion sources, wherein a first ion source is capable to produce $H_3O^+$ out of $H_2O$ vapor, a second ion source is capable to produce $O_2^+$ out of $O_2$ and a third ion source is capable to produce $NO^+$ out of $N_2$ and $O_2$. The angle between adjacent ion sources can measure essentially 120 angular degrees.

Preferably the ion sources are hollow cathode ion sources.

In a preferred embodiment it is provided that the sample gas inlet exhibits a first part of the sample gas inlet and a second part of the sample gas inlet, wherein the second part of the sample gas inlet is adjacent to the first part of the sample gas inlet. Preferably the sample gas inlet is in the direction of the central axis of the reaction chamber, wherein the sample gas inlet is essentially parallel to the central axis, preferably in immediate vicinity to the central axis.

Particularly preferred the second part of the sample gas inlet is downstream the first part of the sample gas inlet, wherein the diameter of the second part of the sample gas inlet is preferably less than the first part of the sample gas inlet, wherein the first part and the second part of the sample gas inlet are fluidically connected.

Preferably the second part of the sample gas inlet is fluidically connected with the ion source section and the ion source section is fluidically connected with the reaction chamber.

In an embodiment the apparatus comprises a sample inlet bypass line, wherein the sample inlet bypass line is arranged essentially perpendicular to the sample gas inlet. In a two-part sample gas inlet the sample inlet bypass line is preferably fluidically connected with the first part of the sample gas inlet.

Preferably a gas line is arranged essentially perpendicular to the sample gas inlet. In a two-part sample gas inlet the gas line is preferably fluidically connected with the second part of the sample gas inlet.

A particularly preferred embodiment provides that the ion source section consists of at least two electrodes, preferably of at least three electrodes, wherein at least one electrode is positioned opposite to each ion source and/or at least one electrode is positioned in the immediate vicinity of the second part of the sample gas inlet and/or at least one electrode is positioned in the immediate vicinity of the reaction chamber.

The electrodes constitute a chamber-like entity referred to as the ion source section, comprising ion sources outside of the chamber-like entity, wherein the ion sources are fluidically connected with the inside of the chamber-like entity. Preferably the axes of the ion sources point essentially to the center of the ion source section.

The at least two ion sources can be positioned between the electrode which is positioned in the immediate vicinity of the second part of the sample gas inlet and the electrode which is positioned in the immediate vicinity of the reaction chamber.

Preferred the at least two ion sources comprise at least one electrode, with which the injection of reagent ions into the ion source section and/or the rejection back into the respective ion source is feasible.

The sample gas inlet is preferably arranged along the central axis and leads to the reaction chamber.

In one embodiment the at least one electrode is positioned opposite to each ion source and/or at least one electrode is positioned upstream in the vicinity of the sample gas inlet and one electrode is positioned downstream in the vicinity of the reaction chamber.

Preferably each ion source comprises at least one electrode at the exit.

With respect to the method it can be provided that a voltage is applied to the at least one electrode opposite to the at least two ion sources, wherein said electrode causes a repulsive force onto the reagent ions.

Particularly preferred a controlling device controls the voltages applied to the electrodes, wherein the controlling device controls which kind of the reagent ions generated in the respective ion source will be injected into the ion source section and/or which kind of reagent ions generated in the respective ion source will be rejected back into the respective ion source.

In a special variant, the controlling device adapts the parameters of the apparatus, such that the apparatus on demand acts as an Atmospheric Pressure interface Mass Spectrometer, wherein the parameters comprise at least the voltages applied to the electrodes, wherein the controlling device controls that the ions generated in the ion sources are rejected back into the respective ion sources or the ion sources are switched off by the controlling device such that no reagent ions are generated.

Further embodiments and advantages are explained by reference to the figures.

DETAILED DESCRIPTION OF THE INVENTION

Figure 1:
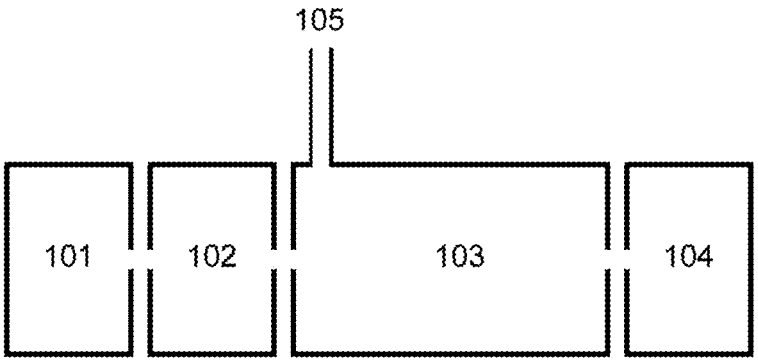
Prior Art Fig. 1
FIG. 1 shows a schematic view of the prior art of IMR/PTR-MS instruments.

FIG. 1 is a schematic overview of the prior art, with a reagent ion source comprising a first part 101 and a second part 102, a drift tube 103, a mass analyzer 104 and a sample inlet 105. Water vapor originating from a reservoir filled with purified water enters the first part 101 of the ion source. In the first part 101 a hollow cathode discharge converts $H_2O$ molecules into a series of product ions: $H_2O^+$, $H^+$, $H_2^+$, $OH^+$ and $O^+$. As eventually highly pure $H_3O^+$ reagent ions are needed in the second part 102 of the ion source also called "source drift" region the product ions from the first part 101 and the water vapor, which are both transferred into the second part 102 via gas flow and/or electric fields, undergo various ion-molecule reactions which lead to $H_3O^+$ purity levels of 99% and above. The underlying ion-chemistry has been discussed in detail in literature. Subsequently, the $H_3O^+$ reagent ions are injected into drift tube 103, where they can interact with the gas containing the analytes (e.g. air with trace compounds) introduced into the drift tube via sample inlet 105.

It has been shown that this ion source design can also be used for the production of very pure reagent ions apart from $H_3O^+$, e.g. $NO^+$, $O_2^+$, $Kr^+$, $Xe^+$, $NH_4^+$, $OH^-$, etc. by switching the source gas and adjusting the currents and voltages applied to and the pressure in the ion source.

Figure 2:
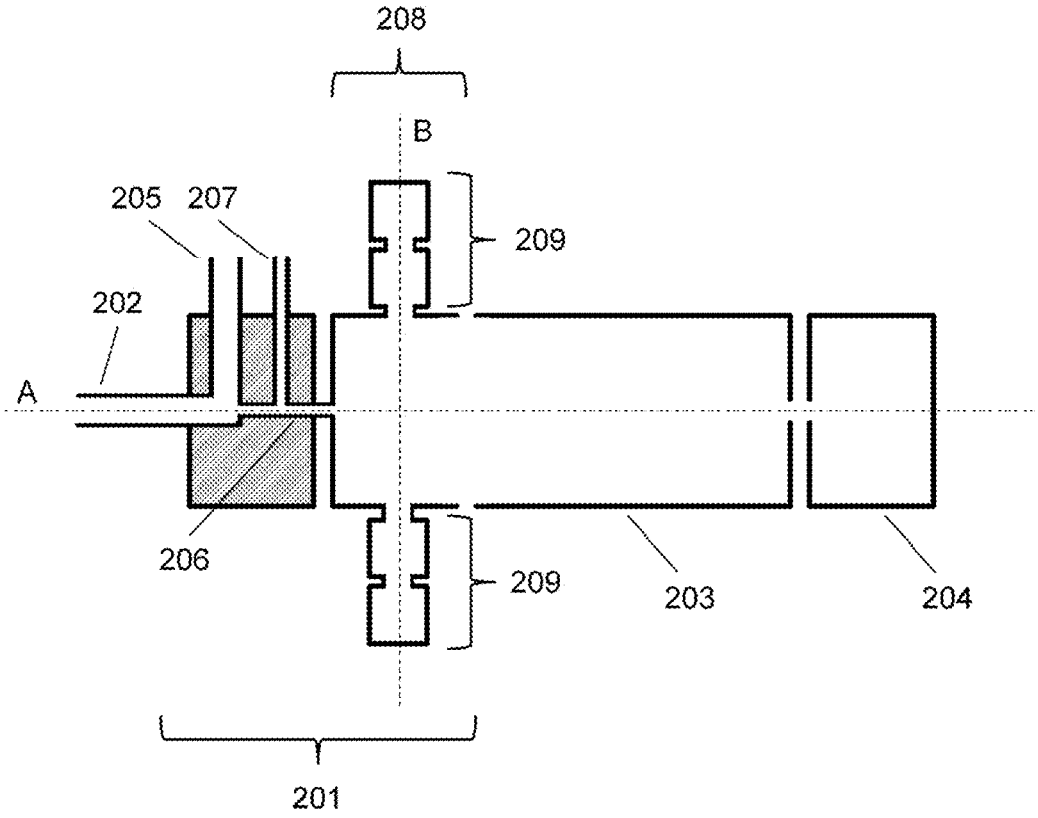
FIG. 2 shows a schematic view of an exemplary IMR/PTR-MS instrument according to the present invention.

The invention relates to a front end of an IMR/PTR-MS instrument, denoted 201 in FIG. 2. Sample gas is drawn into the instrument via a sample gas inlet 202, 206 (also termed as sample inlet), which is essentially in direction of the central axis A of the reaction chamber 203 to the mass analyzer 204. A sample inlet bypass line 205 allows for regulating the sample inlet flow while keeping the flow into the reaction chamber 203 constant. That is, a vacuum pump (membrane pump, scroll pump, multi-stage turbomolecular pump, etc.) is connected to the sample inlet bypass line 205.

In a preferred embodiment a mass flow controller, valve or similar device which allows for regulating the air flow is installed between the sample inlet bypass line 205 and the vacuum pump. If this flow regulating device is completely closed so that no suction is created via sample inlet bypass 205 only a minimum amount of gas is sampled (the sample gas flow which enters the reaction chamber 203). If the flow regulating device is opened, virtually any sample inlet flow higher than the minimum can be set. Typically IMR/PTR-MS reaction chambers are operated between 0.1 and 100 hPa, preferably between 1 and 10 hPa. This vacuum is usually maintained by one or more vacuum pumps connected to one or more pumping ports of the reaction chamber 203 and determines the minimum gas flow needed for operating the instrument, i.e. the pressure in 203 results from the gas entering and being pumped away. In line of central axis A is also the second part of the sample gas inlet 206. This part, which is adjacent to the connection point of the sample inlet bypass 205, preferably has a smaller inner diameter than the first part of the sample gas inlet 202, so that the gas flow through 206 is restricted.

Gas line 207 is connected to the second part of the sample gas inlet 206 and to a vacuum pump, which can be the same vacuum pump that is connected to 205 or an additional pump of the same or different type. Preferably a pressure controller, a valve or any gas flow regulating device is interconnected between gas line 207 and the vacuum pump. Via the gas flow/suction through gas line 207 the pressure in the reaction chamber 203 (which itself is evacuated by a vacuum pump) can be regulated.

The sample gas flows into the ion source section 208. This section can be part of the reaction chamber 203 or a separated section. At least two reagent ion sources 209 are mounted in this section essentially perpendicular to axis A, i.e. in plane B. The ion sources 209 can be any IMR/PTR-MS reagent ion sources (e.g. point discharge, plane electrode discharge, microwave discharge, radioactive, etc.). In a preferred embodiment the ion sources 209 are hollow cathode ion sources.

Figure 3:
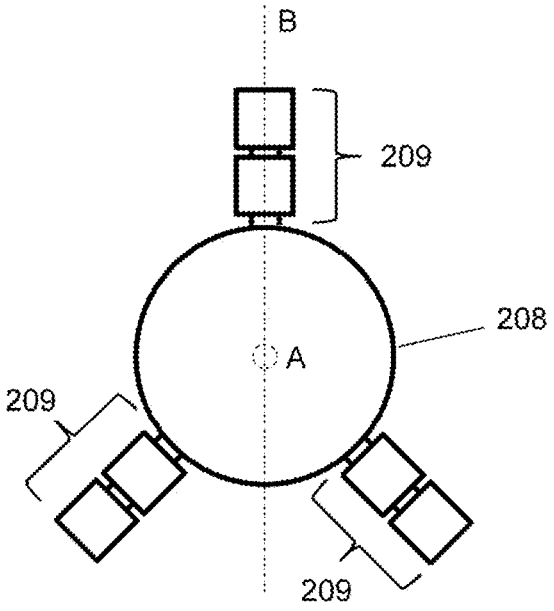
FIG. 3 shows a schematic view of an exemplary reagent ion source arrangement with three ion sources.

FIG. 3 shows a schematic view of an exemplary embodiment in direction of central axis A. Here, three reagent ion sources 209 are mounted at 0°, 120° and 240° (angular degrees) in plane B, which is essentially perpendicular to axis A. In this exemplary embodiment the ion source section 208 has a circular cross section. Any other cross section is also possible, e.g. triangular, rectangular, polygonal, elliptic, any combination of curved and/or straight forms. Any positions of the ion sources 209 are possible, e.g. opposite of each other or at any angle to each other. The number of ion sources 209 has to be at least two.

Figure 4:
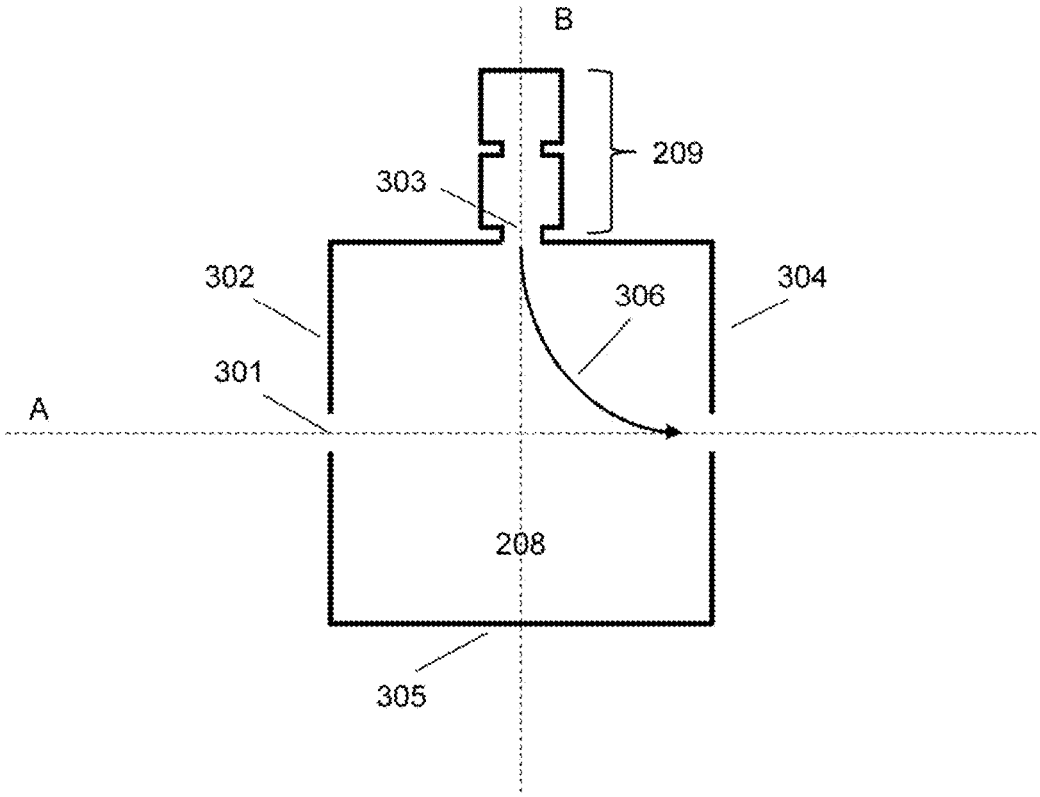
FIG. 4 shows a schematic view of the ion source section according to the present invention.

FIG. 4 shows a schematic view of an exemplary embodiment of the ion source section 208. In this figure the sample gas is introduced from the left via orifice 301 (connected to sample gas inlet 206, not shown here). A DC voltage can be applied to electrode 302. At position 303 is at least one electrode with an orifice (ion lens) where a DC voltage can be applied. By applying an appropriate voltage to electrode 303 the reagent ions generated in the reagent ion source 209 can be injected into the ion source section 208 or rejected, so that they do not enter the ion source section 208. Electrode 304 can either be the first electrode of the IMR/PTR-MS drift tube or an ion lens for injecting reagent ions into the reaction chamber. 305 is an electrode opposite of the reagent ion source, which can e.g. be a metal plate or the electrically conducting inner housing of the ion source section 208. In some embodiments no electrode 305 is present. In a preferred embodiment the function of electrode 305 is substituted or supplemented by electrode 303 of the at least one additional ion source 209 other than the ion source 209 currently injecting reagent ions. By applying appropriate electric potentials/voltages to 302, 303, 304 and 305 reagent ions are guided into the IMR/PTR-MS reaction chamber as schematically indicated by arrow 306.

If according to the present invention at least two reagent ion sources 209 are installed in the ion source section 208, reagent ions can be selected by simply changing the voltages applied to the electrodes. Preferably the voltages that are changed are the voltages of the ion source exit lenses 303.

Figure 5:
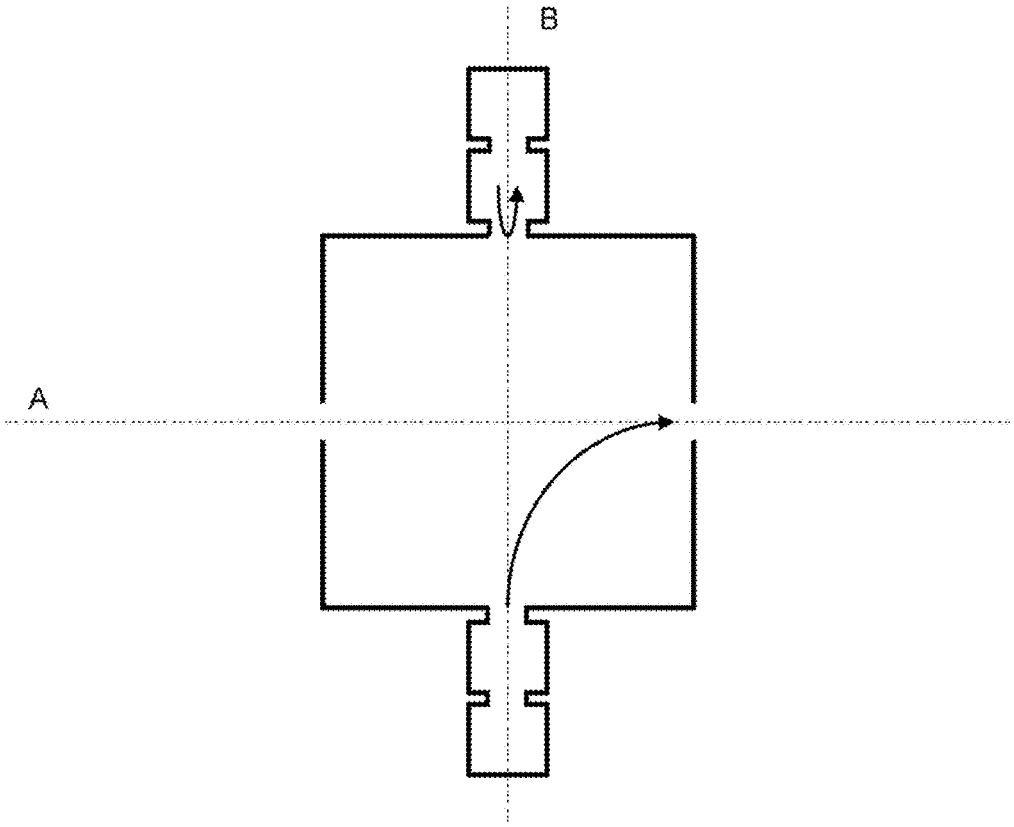
FIG. 5 shows a schematic illustration of an embodiment where one reagent ion source is set to inject reagent ions into the ion source section and one reagent ion source is set to block ions from entering the ion source section.

In FIG. 5 two reagent ion sources are schematically shown, where the reagent ions of one ion source are rejected (do not enter the ion source section and eventually the IMR/PTR-MS reaction chamber) and the reagent ions produced by another ion source are injected into the ion source section and eventually the IMR/PTR-MS reaction chamber. That is, if e.g. one reagent ion source continuously produces one type of reagent ions and a second reagent ion source continuously produces another type of reagent ions, the reagent ions used for chemical ionization in the IMR/PTR-MS reaction chamber can be very rapidly switched by simply changing electrode voltages. In stark contrast to existing designs, no time consuming source gas switching or pressure adjustments have to be performed. It has been shown that the reagent ion yields entering the reaction chamber are of comparable intensity to reagent ion yields of a common single ion source in-line with the reaction chamber's central axis, i.e. intensity losses due to the perpendicular position are negligible.

In a preferred embodiment at least three reagent ion sources are installed, which continuously produce at least $H_3O^+$, $NO^+$ and $O_2^+$, respectively.

In another embodiment at least four reagent ion sources are installed, which continuously produce at least $H_3O^+$, $NH_4+$, $NO^+$ and $O_2^+$, respectively.

Obviously, if for a prolonged measurement it is foreseeable that switching of the reagent ions will not be required, i.e. only one type of reagent ions is necessary, all reagent ion sources except for the one producing the required reagent ions can be turned off in order to save source gas and prevent wear effects. However, in this case no rapid switching is possible.

In another embodiment all reagent ion sources are turned off or set so that they do not inject reagent ions into the reaction region. In this mode of operation the novel front end acts as an APi (Atmospheric-Pressure interface) device and atmospheric ions can be analyzed with the IMR/PTR-MS instrument. In this case no chemical ionization reactions between reagent ions and the sample gas take place within the reaction region, but the reaction chamber only transports the atmospheric ions to the mass analyzer. Again, only electric potentials and voltages have to be changed to enable this mode of operation so that the atmospheric ions are guided into the reaction region and subsequently into the mass analyzer.

Exemplary Embodiment

Figure 6:
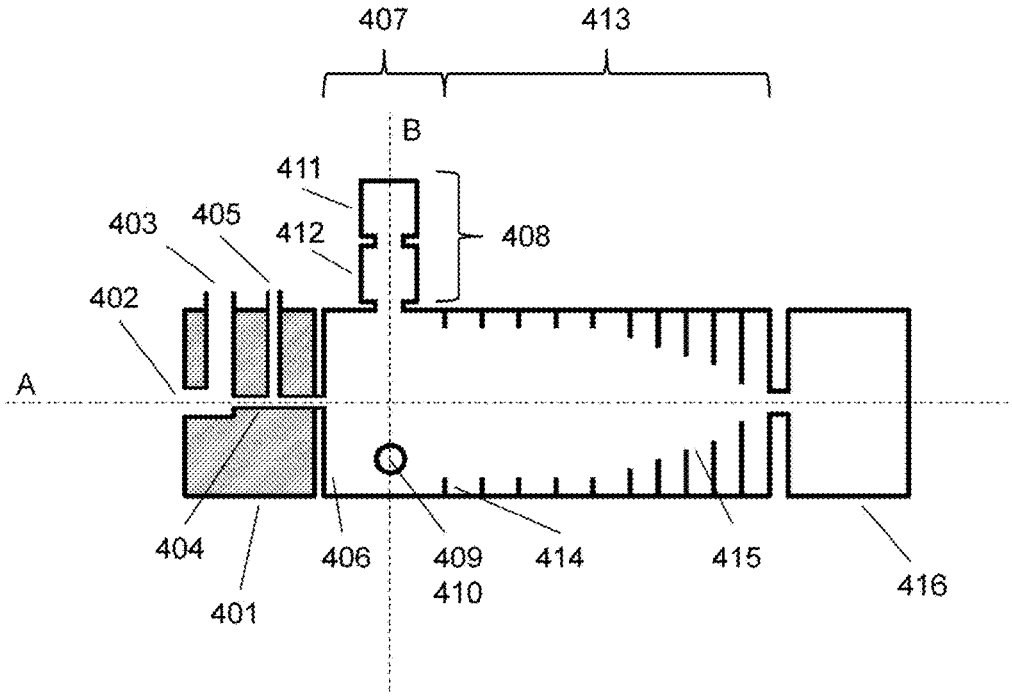
FIG. 6 shows a schematic view of a prototype built according to the present invention.

A schematic view of a prototype embodiment, which only acts as an example and should by no means limit the invention to this embodiment, is displayed in FIG. 6.

In an inlet block 401 an opening 402 is drilled in direction of the central axis A. This opening 402 is equipped with a thread to screw in a 1/16 inch sample inlet line (e.g. made of PEEK (PolyEther Ether Ketone), passivated stainless steel, PTFE, etc.) with 1 mm inner diameter. An opening 403 is drilled perpendicular to opening 402 and connected to a membrane vacuum pump via a mass flow controller. By adjusting the mass flow controller the amount of gas containing the analytes sampled by the instrument can be adjusted from the minimum which is needed for operation of the IMR/PTR-MS instrument (between 10 and 100 $cm^3$/min at standard conditions for the prototype instrument) to the maximum pumping power of the membrane vacuum pump. Adjacent to the drilling 402 there is a drilling 404 with a smaller diameter in direction of the central axis A. Perpendicular to drilling 404 there is a drilling 405 which is connected to the same vacuum pump as drilling 403, but with an interconnected pressure controller instead of a mass flow controller. By adjusting this pressure controller the (resulting) pressure in the IMR/PTR-MS reaction chamber can be adjusted. The second part of the inlet line 404 ends in an electrode/ion lens 406 at the beginning of the ion source section 407.

Three hollow cathode reagent ion sources 408, 409 and 410 (the latter two are only indicated in the schematic view) are mounted perpendicular to central axis A in plane B at 120° offset angle, respectively (compare FIG. 3). All three reagent ion sources are of the same design: A first ionization chamber 411 and a second ionization chamber 412. Both ionization chambers are essentially made of a conductive material. Preferably the conductive material is stainless steel, such as stainless steel type EN 1.4301, 1.4405 or 1.4407. One or more source gases are introduced via mass flow controllers into the first chamber 411, where a hollow cathode discharge ionizes the source gas. Typical source gases are $H_2O$ vapor for $H_3O^+$, $O_2$ for $O_2^+$, a mixture of $N_2$ and $O_2$ for $NO^+$ and a mixture of $N_2$ and $H_2O$ vapor for $NH_4^+$ production. Ions and neutrals subsequently enter a second ionization chamber 412 where they react via ion-molecule reactions and highly pure reagent ions of one particular type are formed. Ionization chamber 412 is connected to a vacuum pump via an electronically controlled (proportional) valve so that the pressure can be regulated. Electric fields can be applied to ionization chambers 411 and 412 in order to control the hollow cathode discharge, transport the ions and control the ion-molecule reactions. At least one ion lens at the exit of chamber 412 into the ion source section 407 enables blocking (rejecting) or transmitting the ions.

Each of the three reagent ion sources 408, 409 and 410 continuously produces one particular type of reagent ions. However, only the voltage applied to the exit ion lens of one ion source is set so that these reagent ions can enter the ion source section 407. The remaining two reagent ion types are hindered from entering the ion source section 407 by the voltage applied to the exit ion lenses. After entering the ion source section 407 the reagent ions are drawn in direction of central axis A by electric fields. These fields are e.g. created by electrode 406 and the ring electrodes of the reaction chamber 413.

Additionally, the electrodes at the exits of chambers 412 can create electric fields which penetrate to some extent into the ion source section 407. That is, at the exit electrodes of those reagent ion sources which are set so that they do not inject reagent ions into the ion source section 407 a repulsive electric potential is applied to. This repulsive potential hinders reagent ions from exiting the respective ion sources.

On the other hand, it pushes reagent ions originating from another reagent ion source towards central axis A. In other words the reagent ions which are injected into the ion source section 407 from one "active" reagent ion source 408 are repelled by electrode 406 and the exit electrodes of the other two "inactive" reagent ion sources and drawn into the reaction chamber 413. For example, if the reagent ion source at 0° (angular degrees) produces $H_3O^+$ reagent ions and injects these reagent ions via acceleration due to at least one electrode at the exit of chamber 412 into the ion source section 407, the exit electrodes of the remaining two reagent ion sources at 120° and 240° are set so that they do not inject reagent ions into the ion source section 407. The repulsive electric field created by these two electrodes helps to keep the $H_3O^+$ reagent ions originating from the reagent ion source at 0° close to central axis A, i.e. force them on a flight path close to the one indicated by arrow 306 in FIG. 4.

The reaction chamber 413 in this exemplary embodiment comprises a series of ring electrodes with constant orifice diameters 414 and an adjacent series of ring electrodes with decreasing orifice diameters 415. DC voltages are applied across electrodes 414 and 415 so they act as an IMR/PTR-MS drift tube. Additionally applied RF voltages allow for focusing the ions and thus prevent ion losses. The reaction chamber is evacuated to between 1 and 10 hPa by a vacuum pump connected to a pumping port in 413. Eventually, the ions are transferred into region 416, which represents a differential pumping region, a TOF mass analyzer and a microchannel plate detector.

With the present invention sample gas can be introduced in-line with the central axis of the reaction chamber of an IMR/PTR-MS instrument. Although the inlet gas flow as well as the pressure in the reaction chamber can be fully controlled, the sample gas does not pass any valve, mass flow controller or similar device on its way into the reaction chamber. Moreover, there are no bendings or kinks the sample gas has to pass, but it can directly enter the reaction chamber. This greatly improves the instrument's response and decay time because wall-effects, such as sample-wall interactions, are suppressed. In combination with the possibility of extremely rapid reagent ion switching, because of at least two reagent ion sources simultaneously producing reagent ions, an IMR/PTR-MS instrument according to the present invention is much faster, more selective and sensitive compared to existing designs.

By switching off all reagent ion sources or setting them so that none of them injects reagent ions into the reaction region, the front end according to the present innovation acts as an APi. This is only possible because the sample gas inlet design suppresses contact between the sample gas and walls, which would inevitably lead to the loss of (atmospheric) ions. Thus, an instrument equipped with this front end is extremely cost efficient as two types of instrumentation are combined in one: APi-MS and IMR/PTR-MS.

The invention claimed is:

1. An apparatus for Ion-Molecule-Reaction Mass Spectrometry and/or Proton-Transfer-Reaction Mass Spectrometry, comprising:

a sample gas inlet;

an ion source section;

a first reagent ion source;

a second reagent ion source;

a reaction chamber; and a mass analyzer, wherein the reaction chamber and the mass analyzer are arranged along a central axis, wherein the sample gas inlet is arranged to introduce gas essentially along the central axis into the ion source section that is connected to the reaction chamber, wherein the reaction chamber is placed downstream and essentially adjacent to the ion source section, wherein the first reagent ion source and the second reagent ion source are arranged essentially in a plane in front of the reaction chamber so as to emit reagent ions essentially perpendicularly to the central axis into the ion source section, said apparatus further comprising at least one electrode, such that the reagent ions emitted from the first or second reagent ion source into the ion source section can be deflected into the reaction chamber essentially in the downstream direction of the central axis, wherein each reagent ion source comprises at least one electrode with which the injection of reagent ions into the ion source section and/or rejection back into the respective reagent ion source is feasible, wherein said electrodes are connected to a switching device so that emitted reagent ions from one reagent ion source are deflected into the central axis while reagent ions from any other reagent ion source are prevented from entering the reaction chamber.

2. The apparatus according to claim 1, wherein at least one further reagent ion source is arranged so as to emit reagent ions essentially perpendicularly to the central axis.

3. The apparatus according to claim 1, wherein the reagent ion sources are arranged essentially in a plane which is essentially perpendicular to the central axis of the reaction chamber.

4. The apparatus according to claim 2, wherein each one of the three reagent ion sources is capable of producing one type of ions out of the group of H3O+, O2+ and NO+, wherein each one of the three reagent ion sources is configured to produce a different type of ions.

5. The apparatus according to claim 1, wherein the apparatus comprises a sample inlet bypass line, wherein the sample inlet bypass line is arranged essentially perpendicular to the sample gas inlet.

6. The apparatus according to claim 5, wherein the apparatus comprises a gas line, wherein the gas line is arranged essentially perpendicular to the sample gas inlet.

7. The apparatus according to claim 1, wherein at least one electrode is positioned opposite to each reagent ion source and/or at least one electrode is positioned upstream in the vicinity of the sample gas inlet and one electrode is positioned downstream in the vicinity of the reaction chamber.

8. The apparatus according to claim 7, wherein each reagent ion source comprises at least one electrode at its exit.

9. A method to operate an apparatus for Ion-Molecule-Reaction Mass Spectrometry and/or Proton-Transfer-Reaction Mass Spectrometry according to claim 8, comprising the following steps:

introducing sample gas into the ion source section via the sample gas inlet in the direction of the central axis of the reaction chamber;

continuously generating at least two different reagent ions in the at least two reagent ion sources, wherein in one respective reagent ion source one specific type of reagent ions is produced;

applying a voltage to the at least one electrode at the exit of each reagent ion source, wherein a certain value of voltage leads to injection of the respective reagent ions into the ion source section and another certain value of the voltage leads to rejection back into the respective reagent ion source;

applying a voltage to the at least one electrode positioned upstream in the vicinity of the sample gas inlet, wherein this electrode causes a repulsive force onto the reagent ions, and applying a voltage to the at least one electrode positioned downstream in the vicinity of the reaction chamber, wherein this electrode causes an attracting force onto the reagent ions, such that the reagent ions are injected into the reaction chamber essentially in the downstream direction of the central axis (A) of the reaction chamber;

introducing the reagent ions and the sample gas into the reaction chamber, wherein subsequent to the reaction chamber the ions are analyzed with the mass analyzer.

10. The method according to claim 9, the method comprising applying a voltage to the at least one electrode opposite to the at least two ion sources, said electrode causing a repulsive force onto the reagent ions.

11. The method according to claim 9, characterized in that a controlling device controls the voltages applied to the electrodes, wherein the controlling device controls which kind of the reagent ions generated in the respective ion source will be injected into the ion source section and/or which kind of reagent ions generated in the respective reagent ion source will be rejected back into the respective ion source.

12. The apparatus according to claim 1, wherein the apparatus comprises a controlling device.

13. A method to operate an apparatus for Ion-Molecule-Reaction Mass Spectrometry and/or Proton-Transfer-Reaction Mass Spectrometry according to claim 10 comprising the following steps:

introducing sample gas into the ion source section via the sample gas inlet in the direction of the central axis of the reaction chamber;

continuously generating at least two different reagent ions in the at least two ion sources, wherein in one respective ion source one specific type of reagent ions is produced;

applying a voltage to the at least one electrode at the exit of each ion source, wherein a certain value of voltage leads to injection of the respective reagent ions into the ion source section and another certain value of the voltage leads to rejection back into the respective ion source;

applying a voltage to the at least one electrode positioned upstream in the vicinity of the sample gas inlet, wherein this electrode causes a repulsive force onto the reagent ions, and applying a voltage to the at least one electrode positioned downstream in the vicinity of the reaction chamber, wherein this electrode causes an attracting force onto the reagent ions, such that the reagent ions are injected into the reaction chamber essentially in the downstream direction of the central axis of the reaction chamber;

introducing the reagent ions and the sample gas into the reaction chamber, wherein subsequent to the reaction chamber the ions are analyzed with the mass analyzer, wherein a controlling device controls the voltages applied to the electrodes, wherein the controlling device controls which kind of the reagent ions generated in the respective ion source will be injected into the ion source section and/or which kind of reagent ions generated in the respective ion source will be rejected back into the respective ion source, wherein the controlling device adapts the parameters of the apparatus, such that the apparatus on demand acts as an Atmospheric Pressure interface Mass Spectrometer, wherein the parameters comprise at least the voltages applied to the electrodes, wherein the controlling device controls that the ions generated in the ion sources are rejected back into the respective ion sources or the ion sources are switched off by the controlling device such that no reagent ions are generated.

* * * * *